United States Patent [19]

Parikh et al.

[11] 4,412,871

[45] Nov. 1, 1983

[54] CAST COPPER ALLOYS

[75] Inventors: Prakash D. Parikh, Hamden; Louis P. Stone, Naugatuck; Eugene Shapiro, Hamden; Derek E. Tyler, Cheshire, all of Conn.

[73] Assignee: Olin Corporation, New Haven, Conn.

[21] Appl. No.: 349,212

[22] Filed: Feb. 16, 1982

Related U.S. Application Data

[63] Continuation of Ser. No. 146,833, May 5, 1980, abandoned.

[51] Int. Cl.[3] ..... C22C 9/02; C22F 1/08

[52] U.S. Cl. ..... 148/2; 148/11.5 C

[58] Field of Search ..... 148/2, 11.5 C, 32, 32.5; 75/154, 160, 162

[56] References Cited

U.S. PATENT DOCUMENTS

| | | |
|---|---|---|
| 1,881,257 | 10/1932 | Bassett, Jr. . |
| 1,956,251 | 4/1934 | Price . |
| 2,062,448 | 12/1936 | Deitz, Jr. et al. . |
| 2,066,512 | 1/1937 | Archer . |
| 2,257,437 | 9/1941 | Weiser . |
| 3,317,994 | 5/1967 | Cofer et al. . |
| 3,923,555 | 12/1975 | Shapiro et al. . |
| 3,923,558 | 12/1975 | Shapiro et al. . |
| 4,067,750 | 1/1978 | Mravic et al. . |
| 4,148,633 | 4/1979 | Parikh . |

FOREIGN PATENT DOCUMENTS

| | | |
|---|---|---|
| 756035 | 4/1952 | Fed. Rep. of Germany . |

OTHER PUBLICATIONS

Jackson et al., "A Preliminary Assessment of the Value of Minor Alloy Additions in Counteracting the Harmful Effect of Impurities on the Hot Workability of Some Copper Alloys", Journal of the Institute of Metals, vol. 98, 1970, pp. 193–198.

*Primary Examiner*—Peter K. Skiff
*Attorney, Agent, or Firm*—Paul Weinstein

[57] ABSTRACT

The disclosure teaches improved cast copper alloys exhibiting surprisingly good hot rollability and a method of processing copper base alloys to provide cast structures having good hot rollability, especially those containing silicon and tin. In accordance with the method of the invention, ingots are direct chill cast in a mold from liquid metal wherein the melt temperature entering the mold is 100° to 350° C. in excess of the liquidus temperature.

5 Claims, 4 Drawing Figures

CAST COPPER ALLOYS

This application is a continuation, of application Ser. No. 146,833, filed May 5, 1980, abandoned.

BACKGROUND OF THE INVENTION

The present invention deals with the provision of cast structures having good hot rollability.

The commercial production of wrought copper base alloys is naturally seriously affected by edge cracking of the alloys during hot rolling or hot working. Silicon-tin bronzes in particular have been found to be susceptible to this edge cracking phenomenon. This is naturally a serious problem commercially. Ternary copper base alloys which contain silicon and tin are even more susceptible to the edge cracking phenomenon, but these ternary alloys are nonetheless desirable for commercial production because they provide a good combination of stress corrosion resistance, high strength and formability.

Various means have been suggested in the art in order to counteract the edge cracking problem, especially in silicon and tin containing copper base alloys. Such means have included both different combinations of elemental additions and ways to vary the hot working process. For example, copper base alloys containing silicon and tin together with mischmetal are taught in U.S. Pat. No. 4,148,633. While this patent does provide improvement in the edge cracking phenomenon, it is naturally desirable to provide even greater improvement and to provide such improvement without the necessity for adding alloying additions. Of further interest is "A Preliminary Assessment of the Value of Minor Alloy Additions in Counteracting the Harmful Effect of Impurities on the Hot Workability of Some Copper Alloys" by R. J. Jackson et al. in the *Journal of the Institute of Metals,* Volume 98 (1970), Pages 193–198. This article discusses copper alloys which contain impurities such as lead and bismuth. These metals may have their tendencies to crack during hot working reduced by the addition of such materials as thorium, uranium and mischmetal. Other patents of interest include U.S. Pat. Nos. 1,881,257, 1,956,251, German No. 756,035, U.S. Pat. Nos. 2,257,437, 2,062,448 and 3,923,555.

It is, therefore, a principal object of the present invention to provide a method of processing silicon-tin bronzes to provide cast structures having good hot rollability.

it is a still further object of the present invention to provide such a method which yields a copper base alloy which is resistant to edge cracking during hot working.

It is a further object of the present invention to provide a method as aforesaid which does not rely on expensive processing variations or alloying additions.

It is a still further object of the present invention to provide improved cast copper alloys which are resistant to edge cracking during hot rolling.

Further objects and advantages of the present invention will appear from a consideration of the following specification.

SUMMARY OF THE INVENTION

The foregoing objects and advantages are readily accomplished in accordance with the method of the present invention. The method of the present invention is a method for processing copper base alloys especially those containing silicon and tin to provide cast structures having good hot workability. Hot rolling is the preferred processing practice, however, any hot working step is contemplated in accordance with the process of the present invention, such as drawing or extrusion. Throughout the present specification, however, hot rolling will be discussed as the preferred hot working step.

In accordance with the method of the present invention ingots are direct chill cast, preferably of silicon-tin bronzes, in a mold from liquid metal wherein the melt temperature entering the mold is 100° to 350° C. in excess of the liquidus temperature. This simple, convenient and expeditious practice provides a copper base alloy which is resistant to edge cracking during hot rolling.

The present invention also provides improved cast structures which exhibit surprisingly good hot rollability. The cast copper base alloys comprise a first external inversely segregated surface zone, a second bulk ingot zone and a subsurface denuded zone bridging said first and second zones exhibiting a uniform coarse grain structure which is devoid of second phases. Although the improved cast structures are preferably present in silicon-tin bronzes as aforesaid, it is a finding of the present invention that the present process preferentially provides said structures with resultant improved hot rollability in copper alloys generally, as, for example, in aluminum bronzes, tin bronzes and tin brasses. In view of the remarkable improvement effected by the present invention with regard to the particularly troublesome silicon-tin bronzes, the present invention will be discussed hereinbelow with regard to this alloy system.

DETAILED DESCRIPTION

Figure 1:
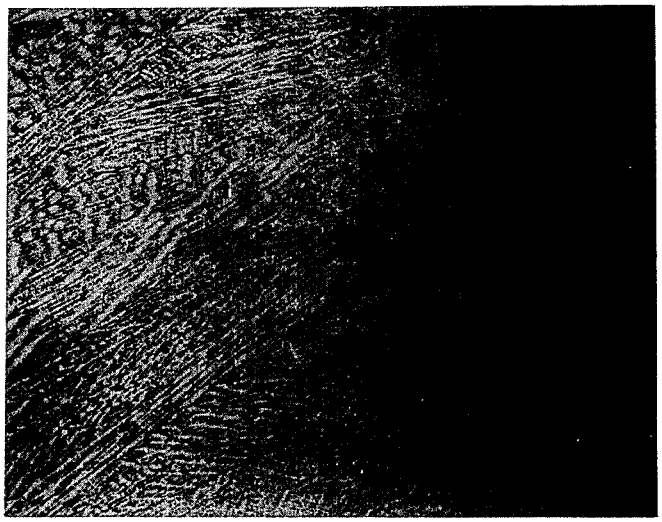
FIG. 1 is a photograph of a DC cast silicon-tin bronze showing the subsurface region thereof produced using conventional processing with the photograph taken at a magnification of 12×.

In preparing castings for molten metal, it is necessary to superheat the liquid metal in order to provide sufficient fluidity to fill the mold. In accordance with conventional practice, an excess superheat is avoided in order to maximize utilization of energy, minimize pickup of harmful gases, minimize the loss of volatile elements and minimize wear on refractory parts.

Hence, normal pouring practices for silicon-tin bronzes provide for a 30° to 70° C. superheat at the point where the liquid metal enters the casting mold.

In accordance with the process of the present invention, surprisingly improved cast structures are obtained utilizing higher than normal superheats in direct chill casting. The process of the present invention superheats the liquid metal to a temperature of from 100° to 350° C. in excess of the liquidus temperature, and preferably 150° to 250° C. in excess of the liquidus temperature. Ingots are then cast in a mold from the liquid metal wherein the melt temperature entering the mold is in said higher superheated range. It is surprising and unexpected to find that this simple and expeditious practice yields the improvements of the present invention.

Ingots cast by the DC or direct chill casting method exhibit characteristic structural features that are inherent in the modes of heat extraction effected by this technique. Thus, a typical DC casting arrangement provides for the transfer of molten metal into a water cooled copper mold via a downspout distributor or similar distribution means. Solidification of the liquid metal is effected by heat transfer through the water cooled mold and by the direct impingement of water onto the ingot as it emerges from the mold. The ingot shell with associated fine grained structure is formed rapidly under high rates of heat extraction when the molten metal and mold are in contact. After reaching some critical thickness the ingot shell shrinks away from the mold wall. Solidification continues but under lower heat transfer conditions. Accordingly, the subsurface region so formed exhibits a coarser structure. Solidification of the major part of the ingot section is achieved by the direct impingement of the sub-mold coolant onto the ingot surface. The resultant structure is fine adjacent to the above subsurface region, and coarsens gradually on approaching the ingot center. Typically, the high growth rate conditions operative during this solidification of the bulk realizes formation of columnar grains.

The formation of the subsurface region is of particular relevance to the present invention. In solidifying alloys, solute rich phases are formed in the dendrite arms and at grain boundaries. These phases possess lower melting temperatures than the primary dendrites. Accordingly, during formation of the above discussed subsurface region, when the heat extraction process is diminished the temperature of the ingot shell increases and these solute rich phases tend to remelt. As a result, inverse segregation and seams or spikes of these phases form along grain boundaries in these reheated regions. These features can and frequently are detrimental to the hot rolling performance of the resultant cast silicon-tin bronze.

Figure 2:
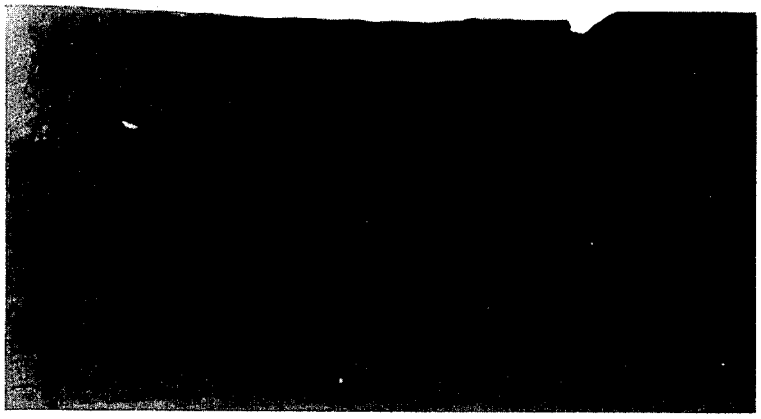
FIG. 2 is a photograph of a heavily cracked plate produced from the casting of FIG. 1 by hot rolling said casing, with the photograph at a magnification of 0.6×.

In accordance with the present invention, it has now been found that in preparing direct chill castings, particularly of silicon-tin bronzes, that the structural features in the subsurface region can be controlled by manipulating the superheat as discussed hereinabove. When using conventional practice with superheats of 30° to 70° C., the subsurface regions contain spikes or grain boundary films of low melting point silicon-tin rich phases as clearly shown in FIG. 1. The hot rollability of such structures is very poor. Cracking initiated at these grain boundary features propagates extensively into the bulk of the ingot as clearly shown in the heavily cracked plate produced by hot rolling the material of FIG. 1, shown clearly in FIG. 2.

Figure 3:
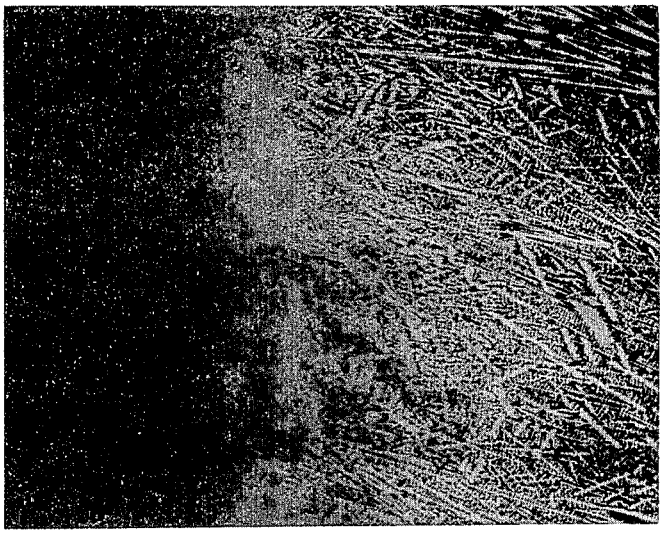
FIG. 3 is a photograph of a DC cast silicon-tin bronze of substantially the same composition as in FIG. 1 produced in accordance with the present invention showing the subsurface region thereof with the photograph at a magnification of 12×.
Figure 4:
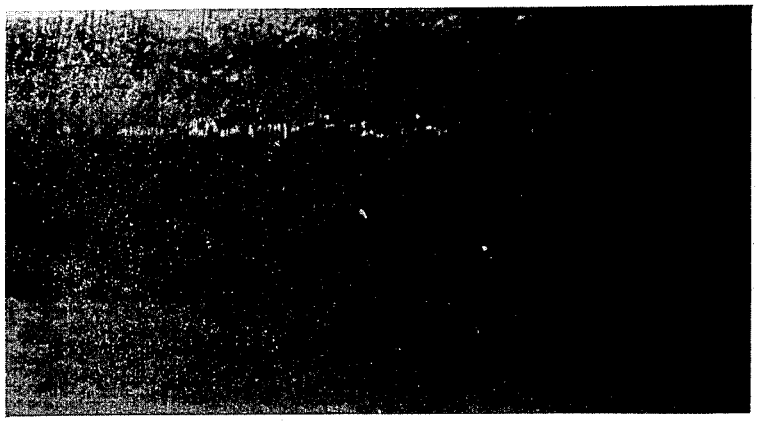
FIG. 4 is a photograph of a crack-free plate produced by hot rolling the casing of FIG. 3, with the photograph taken at a magnification of 0.6×.

However, the use of higher superheats in accordance with the practice of the present invention surprisingly and unexpectedly avoids formation of these seams of low melting point phases as clearly shown in FIG. 3. In addition, the subsurface region exhibits a uniform coarse grain structure which is devoid of second phase. The associated hot rollability is exceptionally good as shown in FIG. 4. Cracks which may be initiated in the exterior inversely segregated surface zone are blunted in this subsurface region so that the hot rollability of the resultant ingot is excellent.

Thus, as clearly shown in FIG. 3, the cast copper alloys of the present invention are characterized by a first external inversely segregated surface zone, a second internal bulk ingot zone, a subsurface denuded zone bridging said first and second zone exhibiting a uniform coarse grain structure which is devoid of second phases. Thus, in accordance with the present invention there are no distinctive phases that bridge the zone between the outside (inversely segregated region) and the bulk of the casting, i.e., the casting is characterized by the presence of a denuded zone as clearly shown in FIG. 3. This should be contrasted to the continuum of second phases which characterize conventional processing as clearly shown in FIG. 1. Hence, cracks initiated in the ingot of FIG. 3 would be blunted by the denuded zone, but would propagate through the continuum of the ingot of FIG. 1. Naturally, the thickness of the zones will depend upon the particular alloy composition and exact processing conditions.

As indicated hereinabove, the process of the present invention preferably deals with silicon and tin containing copper base alloys. The preferred silicon content is from 1 to 6% and the preferred tin content is from 0.2 to 5%. Naturally, if desired for particular properties, alloying additions may readily be added to the silicon-tin bronze, such as mischmetal, chromium, manganese, iron, nickel and the like. Chromium is a particularly preferred addition in an amount of at least 0.03% and preferably in an amount from 0.03 to 1.0%. Also, conventional impurities may be readily tolerated.

The process of the present invention and improvements obtained thereby may be readily seen from a consideration of the following illustrative example.

EXAMPLE I

DC castings 6"×30" in cross section were prepared from alloys having the following compositions:

| | Alloy A | Alloy B |
|---|---|---|
| Silicon | 2.97% | 2.93% |
| Tin | 1.61% | 1.71% |
| Chromium | 0.29% | 0.24% |
| Copper | Essentially Balance | Essentially Balance |

These alloys exhibit a liquidus temperature of about 1050° C. An ingot was direct chill cast from Alloy A such that the melt temperature entering the casting mold was 1130° C., that is, superheat conditions of 80° C. in excess of liquidus were utilized. The resultant cast structure is shown in FIG. 1. As clearly shown in FIG. 1, the subsurface regions contain spikes or grain boundary films of lower melting point tin rich phases. The hot rollability of this casting was poor as clearly shown in FIG. 2 wherein the ingot was hot rolled from 840° C. at two passes with a 15% reduction in each pass. When hot rolling was attempted, cracking was initiated at the aforesaid grain boundaries and propagated extensively into the bulk of the ingot.

When the aforesaid casting practice was modified to Alloy B in accordance with the process of the present invention with all conditions remaining comparable except that the melt temperature entering the casting mold was increased to 1225° C. in accordance with the practice of the present invention, i.e., superheat conditions of 175° C. in excess of liquidus, a preferred coarse subsurface region was obtained free from grain boundary films as clearly shown in FIG. 3. The subsurface region was a denuded zone which exhibited a uniform coarse grain structure devoid of second phases. As a result, when the ingot was hot rolled in the same manner as indicated above for Alloy A, the hot rollability of Alloy B was excellent as clearly shown in FIG. 4.

The patents set forth in this application are intended to be incorporated by reference herein.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method for processing a copper base alloy consisting essentially of from 1 to 6% silicon, from 0.2 to 5% tin and the balance essentially copper, said method providing a cast structure of said alloy having good hot workability, said method comprising:

direct chill casting ingots of said alloy;

said direct chill casting step comprising: providing a water cooled mold; transferring said alloy in molten form into said mold; forming an ingot shell by solidification due to heat transfer within said mold; and directly impinging water onto said ingot as it emerges from said mold, the improvement wherein, said step of transferring said molten alloy into said mold comprises:

transferring said molten alloy at a melt temperature entering said mold of from 150° C. to 250° C. in excess of the liquidus temperature of said alloy, to provide said alloy which is resistant to edge-cracking during hot working and which comprises a first external inversely segregated surface zone, a second internal bulk ingot zone, and a subsurface denuded zone bridging said first and second zones and exhibiting a uniform coarse grain structure which is devoid of second phases.

2. A method as in claim 1 wherein said copper base alloy includes chromium in an amount from 0.03 to 1.0%.

3. A method according to claim 1 wherein the liquid metal is superheated to said temperature prior to entering the mold.

4. A method according to claim 1 wherein said resistant cast structure has good hot rollability and including the step of hot rolling said ingot to provide a hot rolled material free from edge cracking.

5. A cast copper base alloy produced in accordance with the method of claim 1.

* * * * *